United States Patent [19]

Mulder et al.

[11] 4,021,967

[45] May 10, 1977

[54] DOOR LIGHT FASTENER

[75] Inventors: Garvin Mulder; Norman Machiela, both of Holland; George T. Saunders, East Grand Rapids, all of Mich.

[73] Assignee: ODL, Incorporated, Zeeland, Mich.

[22] Filed: Nov. 10, 1975

[21] Appl. No.: 630,178

[52] U.S. Cl. ..... 49/171; 52/455; 52/585; 52/628

[51] Int. Cl.[2] ..... E06B 3/58

[58] Field of Search ..... 49/171, 504, 505, 70; 52/204, 208, 210–214, 309, 397, 455, 456, 458, 476, 585, 628, 753 R, 753 B, 753 C, 714, 716, 455–458; 85/14; 403/309, 313, 305, 303, 304, 293, 405; 109/21.5, 58.5; 88/1; 98/96, 97; 24/81 G, 81 PE, 217 R, 217 W, 249 R, 255 C, 259 C

[56] References Cited

UNITED STATES PATENTS

| | | | |
|---|---|---|---|
| 1,428,076 | 9/1922 | Clark | 403/503 |
| 2,996,767 | 8/1961 | Kobil et al. | 52/214 X |
| 3,203,052 | 8/1965 | Curtis, Jr. | 49/171 X |
| 3,352,191 | 11/1967 | Crawford | 85/14 |
| 3,363,365 | 1/1968 | Laepple | 49/505 |
| 3,760,543 | 9/1973 | McAllister | 52/455 |
| 3,903,669 | 9/1975 | Pease, Jr. et al. | 52/455 |

FOREIGN PATENTS OR APPLICATIONS

| | | | |
|---|---|---|---|
| 332,728 | 11/1958 | Switzerland | 52/208 |

*Primary Examiner*—Roy D. Frazier
*Assistant Examiner*—Terrell P. Lewis
*Attorney, Agent, or Firm*—McGarry & Waters

[57] ABSTRACT

A door light fastener for releasably mounting opposing sections of a door light frame in a door, wherein a plurality of pairs of opposed cylindrical bosses extend inwardly from each of the opposing door light sections, comprises a tubular spring clip that encircles and resiliently holds each pair of bosses together. Inclined barbs in the spring clips permit bosses to be inserted into the ends of the spring clips but inhibit removal of the bosses from the spring clips. A stop projection in each spring clip prevents the bosses from being inserted more than halfway through the spring clip.

12 Claims, 5 Drawing Figures

DOOR LIGHT FASTENER

BACKGROUND OF THE INVENTION

1. Field of the Invention

This invention relates to door lights or windows in doors in more particularly to a spring clip fastener for releasably mounting opposed sections of a door light frame in a door light opening.

2. Description of the Prior Art

A so-called "door light" (sometimes referred to as a door "lite") is a window in a door. Typically, door lights are manufactured separately from the doors in which they are mounted. In a typical construction, a door is manufactured, and a door light opening or hole is provided in the door for the door light. The door light comprises two principal components, a frame and transparent or transluscent pane of glass, plastic or the like mounted in the frame. The frame comprises two opposed sections, each of which fit on opposed sides of the door and overlap slightly with the edge of the door light opening.

The door light is mounted in the door light opening by mounting the opposed sections of the door light frame in the opening with the pane of glass or the like sandwiched between the opposed sections. The two sections are fastened securely together in the opening, and this presses the glass firmly between the sections and holds it in place.

The environment of the present invention is an improved fastener for holding opposed sections of a door light frame together.

One method previously used for fastening door light frames together has been by the use of conventional screws. However, screws must be threaded individually into the frame, and this takes a significant amount of time and expense. A method heretofor developed for holding opposed sections of an injection molded door light frame together comprises the use of cylindrical pins that fit inside aligned openings in the opposed sections of frame. In this type of system, the aligned openings are formed in opposed bosses that extend inwardly from each side of the frame and are positioned at a number of points around the outer periphery of the door light frame. The pins typically are formed of plastic or steel and are supposed to be wedged tightly in the opposing cylindrical openings in the bosses as the two sections of the frame are pressed together with a piece of glass sandwiched between the sections of frame.

One problem encountered with this type of fastener is that the process of molding plastic makes it difficult to obtain sufficiently precise tolerances to provide a perfect fit between the pins and the cylindrical openings in the bosses. Sometimes the opening is too large, and the pin falls out; and sometimes the opening is too small, and the pin can either crack the cylindrical boss or can be wedged so tightly in the opening that separation of the sections of door light frame is impossible without destroying the pin or the bosses. The latter problem is particularly significant when a rigid steel pin is used. Moreover, it can be difficult to align the pins with the openings in the bosses in installing the door light frame.

The problem of imprecise tolerances is aggravated when plastic pins are used, because there can be variation in both the size of the pins and the openings. Moreover, plastic pins are subject to expansion and contraction during hot and cold weather. This can cause the pins to freeze up in the door light frame or fall out of the door light frame.

One object of the present invention is to provide an improved fastener for mounting a door light in a door light opening, wherein the fastener is inexpensive; is easy to align with opposing bosses in opposing sections of the door light frame; holds the opposed sections of door light frame together firmly without requiring precise manufacturing tolerances; and permits separation of the frame sections without damaging the frame.

SUMMARY OF THE INVENTION

In accordance with the present invention, a fastener for releasably mounting opposing sections of a door light frame in a door light opening in a door comprises releasable spring clips that resiliently fit over and hold together each pair of a plurality of pairs of opposed bosses that extend inwardly from opposite points on the opposing door light sections.

The spring clip mechanism of the present invention comprises a tubular member having open ends, with the internal configuration of the tubular member mating with the external configuration of the bosses such that the opposed bosses fit snugly in each end of the tubular member. The bosses are cylindrical in shape. Also, they can be tapered inwardly as they extend outwardly from the frame sections, so that the tubular members fit easily over the ends of the bosses. The tubular members each have a longitudinal slot therein at least in the portion that engages the bosses, so as to permit resilient outward expansion of the tubular members to resiliently engage the bosses.

In one aspect of the present invention, the tubular-members include barbs adjacent each end thereof so as to hold the bosses in the tubular members. The barbs protrude inwardly at an angle such that they face toward the center of the tubular member. The barbs thus permit the bosses to be inserted into the tubular member, but inhibit removal of the bosses once they have been inserted in the tubular member. Preferably, the barbs are V-shaped sections of the tubular wall of the spring clip which are formed inwardly from the walls so that the pointed tips on the V-shaped projections project at an inclined angle toward the center of the fastener.

In another aspect of the present invention, the tubular members include a stop projection extending inwardly into the interior of the tubular member at the middle thereof, so as to prevent the bosses from being inserted more than halfway through the tubular member. A flange on the side of each boss also can be employed to limit the distances the bosses can be inserted into the spring clip.

The fastening mechanism of the present invention is inexpensive and simple to install and does not require close manufacturing tolerances in order to get an acceptably tight fit between the opposed sections of the door light frame. Moreover, the fastener permits separation of the door light frame upon the exertion of an appropriate spreading force between the two sections. Separation does not cause any substantial injury to the door light frame sections.

Other features and advantages of the present invention will hereinafter appear, and, for purposes of illustration, but not limitation, a preferred embodiment of the present invention is described in detail below and shown in the appended drawings.

DETAILED DESCRIPTION OF THE PREFERRED EMBODIMENT

Figure 1:
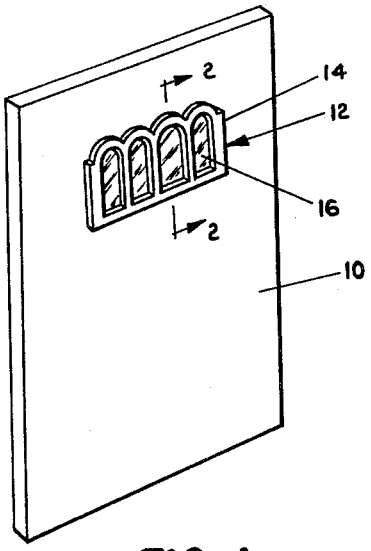
FIG. 1 is a perspective view of a door in which a doorlight has been mounted.

Referring now to the drawings, a conventional door 10 wherein a door light 12 has been mounted on the door by means of the door light fastening mechanism of the present invention is shown in FIG. 1. Door light 12 comprises a frame 14 and a window 16.

Figure 2:
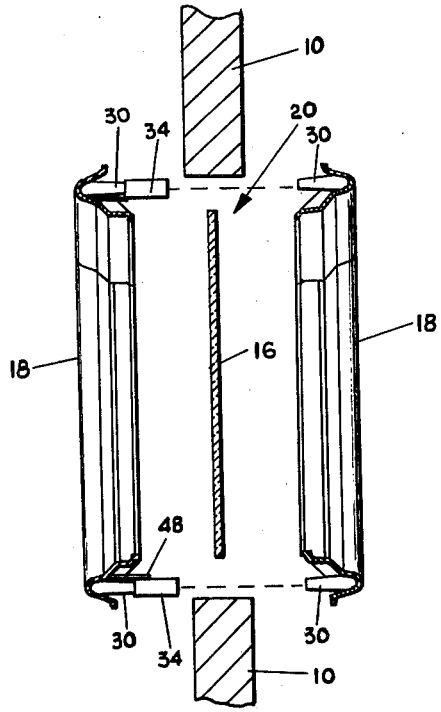
FIG. 2 is a cross-sectional view taken along line 2—2 of FIG. 1, showing the opposed sections of door light frame separated.

As shown in FIG. 2, frame 14 comprises two identical opposed sections 18 which are mounted on oppose sides of a door light opening 20 in the door. Window 16 is positioned between the opposed sections and is clamped in place in the door light opening when the opposed sections are fastened together in the manner shown in FIG. 3.

Figure 3:
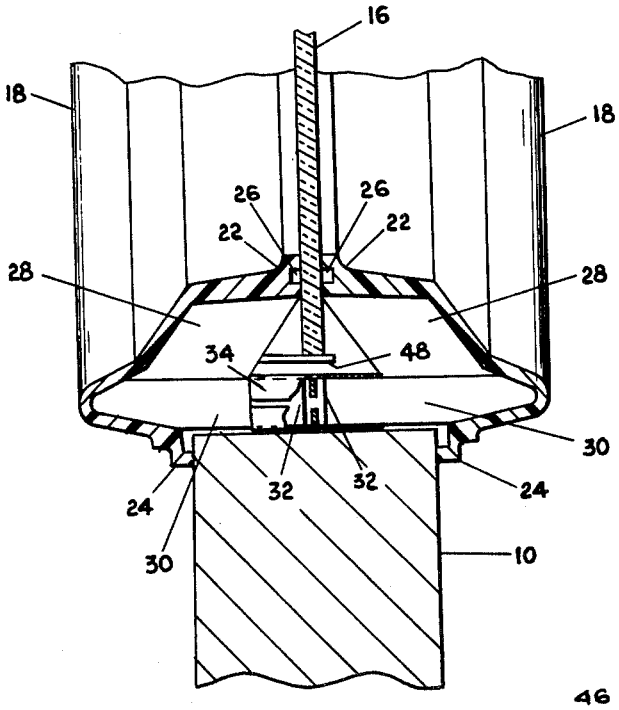
FIG. 3 is a partially broken fragmentary cross-sectional view taken from the same position as FIG. 2, showing one edge of the door light frame mounted on the door light.
Figure 4:
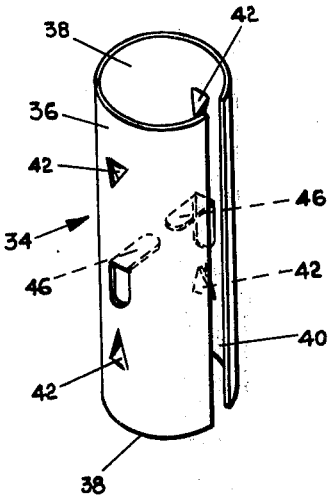
FIG. 4 is a perspective view of the spring clip fastener of the present invention.
Figure 5:
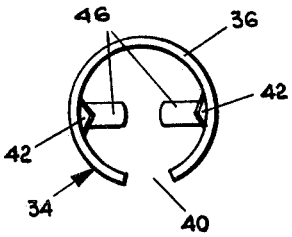
FIG. 5 is an end view of the spring clip fastener of the present invention.

As shown in FIG. 3, each section 18 of the frame comprises an inner edge 22 which extends into contact with window 16 in the interior of the door light opening and an outer edge 24 which fits over the outside of the door light opening and engages door 10. A groove 26 is formed in inner edge 22. A suitable sealing material is inserted in groove 26 so as to seal the junction between the frame and the glass.

Each frame section comprises a plurality of generally cylindrical bosses 30 that extend inwardly into the interior of the door light opening from the outer periphery of the frame section. These bosses are tapered inwardly slightly as they extend away from the frame section. Bosses 30 are formed around the periphery of opposed sections 18 of the frame so as to be positioned in opposed and aligned pairs when the frame sections are joined together. The bosses extend outwardly a sufficient distance so that the ends 32 of the bosses are spaced slightly apart when the frame is mounted in the door (as shown in FIG. 3).

A flange 28 extends between each boss and the inner edge of the frame section.

The door light frame preferably is formed of injection molded plastic. The fastening mechanism of the present invention has special advantages when employed for connecting frame sections that are formed in this manner.

In accordance with the present invention, the opposed sections of the door light frame are mounted in place in the door light opening by means of a plurality of spring clips 34. Each spring clip 34 is a tubular member 36 having open ends 38. Spring clip 34 is formed so that bosses 30 fits snugly into open ends 38 in the manner shown in FIG. 3. Preferably, bosses 30 have a cylindrical outer periphery, and tubular member 36 is annular in shape and fits snugly over the bosses.

Desirably, spring clip 34 is formed of high carbon spring steel having a thickness of 0.020 inches and a length of 0.875 inches. Annealed 1055 spring steel heat threated to a Rockwell hardness of C-42-48 is employed in the preferred practice of the present invention.

Tubular member 36 includes a longitudinal slot 40 along the entire length thereof. Longitudinal slot 40 permits the tubular member to be resiliently expanded outwardly as the tubular member is fitted over a boss 30. This causes a snug, resilient fit between the tubular member and the boss, without requiring precise manufacturing tolerances of either the boss or the tubular member.

In order to hold the bosses snugly in the clips once they have been inserted in the spring clips, a plurality of barbs 42 are formed on the inner surface of the tubular member. Barbs 42 comprise V-shaped sections of the tubular wall which are deformed inwardly into the interior of the tubular clip. This permits the bosses to slide easily over the barbs as the bosses are being fitted into the spring clip. However, when the bosses are moved in a reverse direction, the pointed ends of the barbs engage the bosses and resist outward movement of the bosses. Preferably, the barbs extend inwardly a distance of about 0.020 inches. This produces a snug fit between the bosses and the spring clips and prevents any inadvertent separation of the sections of the frame. However, if separation is desired, the frame sections can be separated by applying an appropriate spreading force between the frame sections. The barbs are sufficiently small so that frame sections can be separated when desired without substantially injuring either the bosses or the spring clip. Thus, after separation, the frame can again be joined together by using the same bosses and the same spring clips.

Spring clips 34 also include a pair of stop projections 46 which extend inwardly into the interior of tubular member 36 at the midpoint thereof. Stop projections 46 prevent a boss from being inserted more than halfway into the spring clip from either side. Thus, if there happens to be a situation where the diameter of the boss on one section of the frame is slightly smaller than the diameter of the boss on an opposing section of frame, the spring clip will not be forced entirely on the smaller boss, but will be forced over both bosses, thus providing a resilient gripping force on both bosses. Without a stop projection, the spring clip could be forced entirely on the one boss and would then not engage and hold the larger boss. Stop projections 46 preferably are formed as sections of the tubular sidewall which are deformed inwardly so as to project at a 90° angle into the interior of the tubular member.

In addition to the stop projections 46, flanges 28 also serve to resist movement of a spring clip entirely onto one boss or the other of an opposed pair. As shown in FIG. 3, the ends 38 of tubular member 36 rest on flanges 28 when the bosses are properly inserted into the spring clip. These flanges, however, are formed of plastic, and the steel spring clips can cut through the flange when a particularly violent clamping force is exerted on the opposed sections of the frame. The addition of stop projections 46 ensures that the spring clip is forced on to both opposed bosses, even if the spring clip cuts into flange 28.

In order to install door light 12 employing the fastener mechanism of the present invention, one section of the door light frame is fitted into the door light opening, with the spring clip being placed on the bosses in that section. The window is then placed in the door light opening against the first section of frame. Flat projections 48 extending outwardly from the sides of section 18 engage and hold window 16 in place on the section until it is clamped firmly in the frame. The other section 18 of frame is then mounted on the other side of the door light opening, with the frame being positioned so that the opposed pairs of bosses are in alignment and the bosses fit into the open ends of spring clips 34. The opposed frame sections are then pressed together so that the bosses are fully inserted into the spring clips, the window is firmly compressed between the frame sections, and the door light is firmly mounted on the door. The pressure on frame sections 18 can be then released, and the spring clips hold the frame sections in their desired position.

It should be understood that various modifications and changes may be made in the arrangements and details of construction of the invention disclosed herein without departing from the spirit and scope of the present invention.

The embodiments of the invention in which an exclusive property or privilege is claimed as follows:

1. Fastener means for releasably mounting opposing sections of a door light frame in a door light opening in a door, wherein a plurality of pairs of opposed bosses extend inwardly from opposite points on the opposing door light frame sections, said fastener means comprising clip means formed such that the clip means slidably fits over each pair of opposed bosses and resiliently holds them together when the opposed sections of the frame are pressed together with the clip means positioned between the opposed bosses.

2. Fastener means according to claim 1 wherein the clip means comprises a tubular member having open ends, the internal configuration of the tubular member mating with the external configuration of the bosses such that the opposed bosses fit snugly in each end of the tubular member.

3. Fastener means according to claim 2 wherein the bosses are cylindrical in shape and the tubular members are formed of a spring material and have longitudinal slots therein at least in portions that engage the bosses so as to permit resilient outward expansion of the tubular members to resiliently engage the bosses.

4. Fastener means according to claim 2 wherein each tubular member further includes inwardly extending barb means adjacent each end for holding the bosses in the tubular member, said barb means permitting the bosses to be inserted into the tubular member but resisting removal of the bosses from the tubular member once inserted.

5. Fastener means according to claim 4 wherein the barb means comprises at least one pointed projection extending into the interior of the tubular member, the projection being inclined toward the center of the tubular member such that the boss slides over the projections when being inserted into the tubular member but engages the pointed end of the projection and is held in place by said projection as the boss is urged in a reverse direction.

6. Fastener means according to claim 5 wherein the projections are V-shaped sections of the wall of the tubular member that extend inwardly from the rest of the wall.

7. Fastener means according to claim 2 and further comprising stop projection means extending inwardly into the interior of the tubular member at the middle thereof, said stop projection means preventing a boss from being inserted more than halfway through the tubular member.

8. Fastener means for interconnecting opposed sections of a molded plastic door light frame in a door light opening in a door, wherein the opposed sections of the door light frame include opposed pairs of generally cylindrical bosses extending coaxially inwardly from the sections, said fastener means comprising:

a tubular spring clip having open ends that snugly fit over the nward end of each pair of opposed bosses, an elongated slot being formed in an axial direction along the side of each spring clip, said elongated slot permitting the resilient expansion of the spring clip so it can resiliently engage the bosses;

barb means extending into the interior of the spring clip adjacent each end thereof for holding the bosses together in the spring clip, said barb means comprising segments of the wall of the spring clip that extend inwardly from the wall at an inclined angle such that ends of the segments face toward the midpoint of the spring clip, the bosses sliding easily over the ends of the segments when being inserted but engaging and being retained by the ends of the segments when being urged in a reverse direction, the segments being sufficiently small and extending a sufficiently small distance into the spring clip to permit the separation of the frame into its two sections without substantial damage to the bosses by the exertion of a strong separating force on the sections; and at least one stop projection means extending inwardly from the spring clip at the midpoint thereof for preventing insertion of a boss more than halfway through the spring clip, said stop projection means including at least one segment of the wall of the spring clip that extends inwardly into the interior of the spring clip.

9. Fastener means for mounting a door light in a door light opening in a door, wherein the door light comprises a molded plastic frame having an outer edge designed to engage the edge of the door light opening and an inner edge that engages a sheet of light transmitting material, the frame being formed in two sections that fit over each side of the door light opening, said fastener means including:

a plurality of cylindrical bosses extending inwardly at right angles from the frame sections, the bosses on the opposing sections being directly opposite each other;

a tubular spring clip having open ends that resiliently fits over the inner ends of each pair of opposed bosses, the tubular spring clip having a slot extending the length of the clip so as to permit resilient outward expansion of the spring clip and including barb means at each end of the clip, said barb means permitting insertion of the bosses into the clip but resisting removal of the bosses from the clip; and flange means extending outwardly from the outer periphery of each boss at a predetermined distance from the end, said flange means limiting the distance the boss can be inserted into the spring clip to said predetermined distance.

10. Fastener means according to claim 9 wherein the bosses are tapered inwardly as they extend inwardly from the sections.

11. Fastener means for mounting a door light in a door light opening in a door, wherein the door light comprises a molded plastic frame having an outer edge designed to engage the edge of the door light opening and an inner edge that engages a sheet of light transmitting material, the frame being formed in two sections that fit over each side of the door light opening, the sections of the frame including a plurality of pairs of opposed, inwardly extending bosses, said fastener means comprising tubular clip means having open ends that fit over the inner ends of each pair of opposed bosses so as to resiliently hold the door light sections together when they are pressed together on a door light opening in a door.

12. Fastener means according to claim 11 wherein the tubular clip means is formed of resilient metal and includes:

a slot extending the length of the clip means so as to permit resilient outward expansion of the clip means for resilient engagement between the clip means and the bosses;

barb means at each end of the clip means for permitting insertion of the bosses into the clip means but resisting removal of the bosses from the clip; and stop projection means extending inwardly into the interior to the clip means for limiting the distance the bosses can be inserted into the clip means.

* * * * *